United States Patent [19]

Zappa et al.

[11] Patent Number: 4,955,403

[45] Date of Patent: Sep. 11, 1990

[54] CLOSED LOOP SYSTEM AND METHOD FOR CLEANING ARTICLES WITH A VOLATILE CLEANING SOLVENT

[75] Inventors: Donald E. Zappa, Pittsburgh, Pa.; James J. Cascone, Voorhees, N.J.

[73] Assignee: Westinghouse Electric Corp., Pittsburgh, Pa.

[21] Appl. No.: 277,847

[22] Filed: Nov. 30, 1988

[51] Int. Cl.[5] ..... B08B 3/10

[52] U.S. Cl. ..... 134/109; 134/25.4; 134/40

[58] Field of Search ..... 34/78, 77, 74, 75; 202/170; 134/109

[56] References Cited

U.S. PATENT DOCUMENTS

| | | | |
|---|---|---|---|
| 1,947,174 | 2/1934 | Sando | 68/18 R |
| 2,011,083 | 8/1935 | Sando | 137/851 |
| 2,171,698 | 9/1939 | Hetzer | 137/210 |
| 2,310,569 | 2/1943 | Booth | 202/170 |
| 2,400,726 | 5/1946 | Wright et al. | 118/52 |
| 3,020,917 | 2/1962 | Lyman | 134/58 |
| 3,079,286 | 2/1963 | Kearney | 202/170 |
| 3,085,415 | 4/1963 | Gosnell | 68/12 R |
| 3,405,452 | 10/1968 | Candor et al. | 34/1 |
| 3,728,074 | 4/1973 | Victor | 252/171 |
| 4,029,517 | 6/1977 | Rand | 134/11 |
| 4,101,340 | 7/1978 | Rand | 134/11 |
| 4,119,560 | 10/1978 | Sheeline | 252/628 |
| 4,235,600 | 11/1980 | Capella et al. | 8/137 |
| 4,348,174 | 9/1982 | Spigarelli | 34/78 |
| 4,390,396 | 6/1983 | Koblenzer | 202/170 |
| 4,443,269 | 4/1984 | Capella et al. | 134/12 |
| 4,556,457 | 12/1985 | McCord | 202/170 |
| 4,561,903 | 12/1985 | Blaul | 134/10 |
| 4,601,181 | 7/1986 | Privat | 68/18 C |
| 4,630,625 | 12/1986 | Capella et al. | 134/104 |
| 4,676,261 | 6/1987 | Blaul | 134/57 R |
| 4,696,114 | 9/1987 | Duval | 34/9 |
| 4,770,197 | 9/1988 | Prisco | 202/170 |

FOREIGN PATENT DOCUMENTS

| | | | |
|---|---|---|---|
| 0071020 | 6/1982 | European Pat. Off. . | |
| 2406868 | 8/1974 | Fed. Rep. of Germany . | |
| 2756145 | 12/1977 | Fed. Rep. of Germany . | |
| 2840138 | 9/1978 | Fed. Rep. of Germany . | |
| 59-162489 | 9/1984 | Japan . | |
| 60-150000 | 8/1985 | Japan . | |
| 60-247199 | 12/1985 | Japan . | |
| 0632409 | 9/1978 | U.S.S.R. | 202/170 |
| 2167056 | 5/1988 | United Kingdom . | |

OTHER PUBLICATIONS

Solvent Series Update by Allied Signal Entitled "We Guarantee Our Solvent Systems".

*Primary Examiner*—Asok Pal
*Assistant Examiner*—Ourmazd Ojan

[57] ABSTRACT

A closed system and method for cleaning articles by means of a volatile cleaning solvent is disclosed herein. The system generally comprises a cleaning chamber having a doorway which, when opened allows access to the interior of the chamber, and when closed seals the chamber interior from the ambient atmosphere, a solvent nozzle disposed within the cleaning chamber for discharging a jet of volatile cleaning solvent on an article within the chamber incident to a cleaning operation, a solvent sump for collecting liquid solvent from the chamber that includes a quantity isolating fluid, which may be water, for forming a liquid curtain over the collected solvent that isolates the solvent from the ambient atmosphere when the chamber door way is opened, and a solvent condenser system connected to the interior of the cleaning chamber for condensing vaporized and atomized solvent discharged by the solvent nozzle into liquid form, and circulating the liquid solvent into the sump.

24 Claims, 1 Drawing Sheet

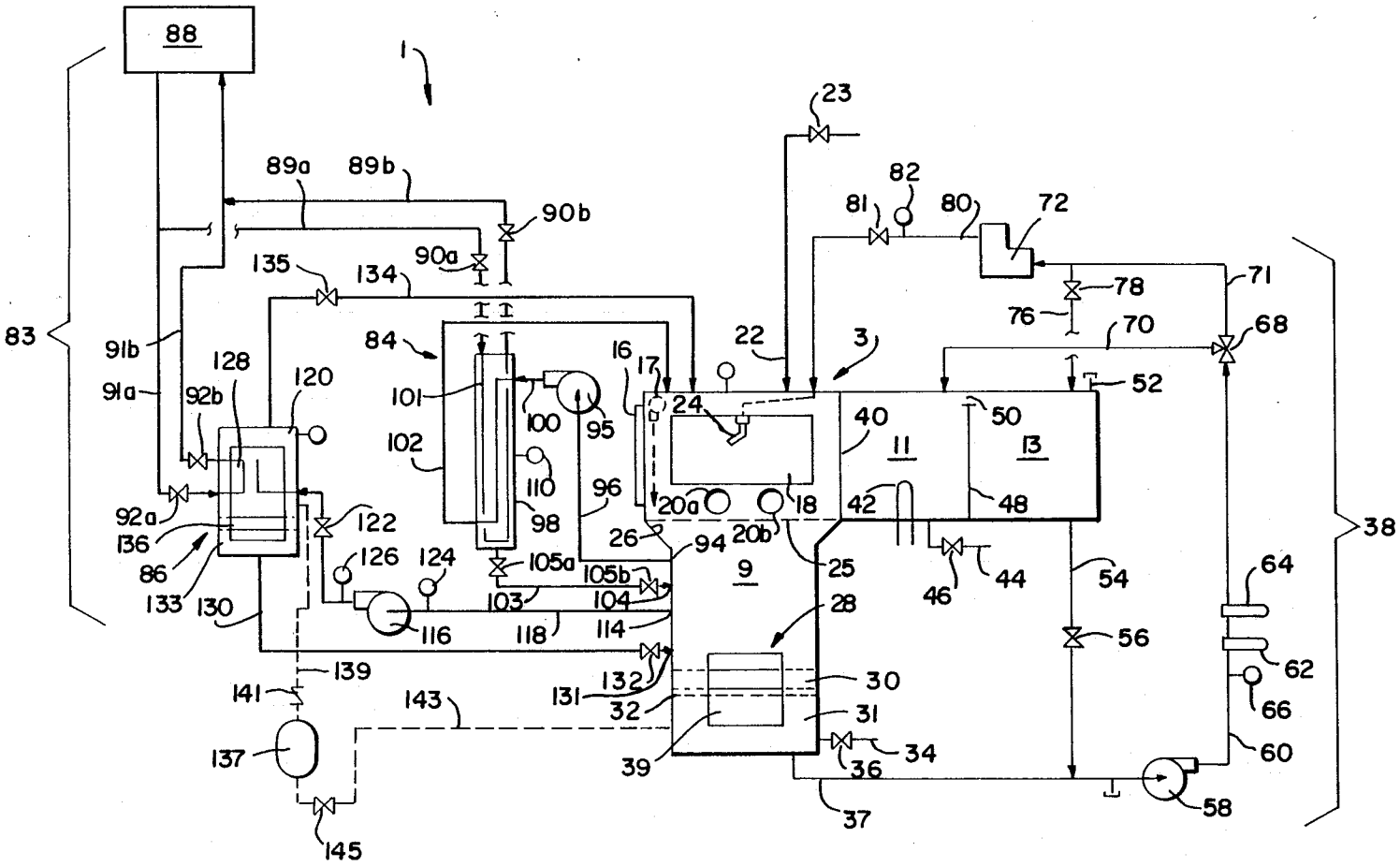
38
71
68
64
62
66
60
58
78
70
52
54
56
72
76
13
50
48
44
46
80
82
81
11
40
42
34
36
37
30
31
23
3
25
28
22
18
20b
9
24
20a
94
17
16
26
105b
104
114
132
32
39
131
95
96
90b
100
110
98
105a
103
118
90a
101
102
124
116
143
89b
134
84
122
126
139
145
89a
135
120
141
137
128
130
92b
133
86
88
91b
91a
92a
136
83
1

CLOSED LOOP SYSTEM AND METHOD FOR CLEANING ARTICLES WITH A VOLATILE CLEANING SOLVENT

BACKGROUND OF THE INVENTION

This invention generally relates to systems for cleaning articles by means of volatile solvents, and is specifically concerned with a closed loop system and method for cleaning contaminated articles with fluorocarbon solvents such as Freon* without releasing any of the fluorocarbon solvent into the atmosphere. * Freon is a registered United States Trademark owned by the I.E. DuPont DeNemours and Company located in Wilimington, Del.

Apparatuses for cleaning articles by means of volatile fluorocarbon cleaning solvents are known in the prior art. Such devices are often used to clean tools and garments used by the maintenance personnel in nuclear power facilities which have become contaminated with radioactive particles. These devices typically include a "glove box" type cleaning chamber that has rubber gloves mounted onto a plexiglass plate so that a worker may slide his hands through the gloves and manipulate and observe the article to be cleaned within the cleaning chamber. A solvent nozzle is included within the cleaning chamber for discharging a high velocity jet of a volatile cleaning solvent, such as Freon 113, against the article to be cleaned and decontaminated. Many of these devices include some sort of solvent formation system that liquifies the solvent vaporized by the solvent nozzle, and collects the solvent in a solvent sump located beneath the cleaning chamber. Some of these devices include a solvent distillation system which boils the used solvent in order to separate it from the particle contaminates and dirt that has become entrained within it, and then condenses the vapors of the distilled solvent back into a liquid solvent which is circulated back to a solvent reservoir connected to the solvent nozzle.

While many of the solvent cleaning devices of the prior art are effective in both decontaminating and cleaning a contaminated and soiled article, and are further capable of reclaiming and recirculating a substantial portion of the Freon 113 or other volatile cleaning solvent they employ, none of these systems is 100 percent effective in preventing the discharge of some Freon or other fluorocarbon solvent into the atmosphere. This is a particularly serious shortcoming, since it is now widely recognized that the discharge of such fluorocarbon solvents into the atmosphere tends to undermine the effectiveness of the ionosphere in shielding the earth from harmful ultraviolet radiation. The threat posed to the ionosphere by such vaporized fluorocarbons has recently induced national sanctions in the form of U.S. Environmental Protection Agency regulations mandating a staged reduction in the use of such fluorocarbons beginning in 1989, as well as international sanctions in the form of the Montreal Protocol of 1988 which likewise calls for reduced usage of volatile fluorocarbons by all industrialized nations commencing in 1989. While there are some prior art cleaning devices that purport to prevent all fluorocarbons from escaping into the atmosphere, the applicants have observed that significant amounts of fluorocarbons do in fact escape from these devices. The most common area of escape observed by the applicants is in the area of the solvent drain and sump. When the door of the cleaning chamber of these systems is opened, there is often a direct interface between the ambient atmosphere and the surface of the liquid Freon which has been collected in the sump at the bottom of the cleaning chamber. Some prior art devices have attempted to eliminate this interface with a pivoting barrier that operates somewhat like a flap valve. However, vapor pressure exerted by the solvent at ambient temperatures can cause some vaporized solvent to leak through such barriers and flow into the atmosphere. The second area of escape is the vent outlets which are present in all prior art devices of which the applicants are aware. Such vent outlets are necessary at various points in such prior art devices in order to avoid build ups of localized pressure which could either render the solvent reclamation system ineffective or possibly rupture the gloves mounted in the glove box of the cleaning chamber. While some of these prior art devices have attempted to address the problem of solvent escape by providing HEPA filters over their vent outlets, the applicants have observed that significant amounts of fluorocarbon solvent escape through these filters.

Clearly, there is a need for a cleaning device having a closed loop system for cleaning articles with volatile cleaning solvents which completely prevents any escape of the solvents into the ambient atmosphere. Ideally, such a system should be at least as effective in cleaning contaminated or soiled articles as prior art solvent cleaning systems, and in reclaiming and recycling cleaning solvents for continuous reuse. Finally, such a system should be safe, reliable, and afford a maximum amount of cleaning in a minimum amount of time.

SUMMARY OF THE INVENTION

Generally speaking, the invention is both the system and a method that overcomes the shortcomings of the prior art by means of a closed loop system that is capable of cleaning articles with volatile cleaning solvents such as Freon 113 without releasing any significant amount of the solvent to the ambient atmosphere. The system generally comprises a cleaning chamber having a doorway that allows access to the interior of the chamber when opened but which seals the chamber interior from the ambient atmosphere when closed, a spray nozzle connected to a source of pressurized solvent for discharging a jet of vaporized volatile cleaning solvent onto an article placed within the cleaning chamber, and a solvent sump for collecting liquid solvent from the cleaning chamber that includes an isolating fluid, which may be water, for forming a film or liquid curtain over the collected solvent that isolates it from the ambient atmosphere when the chamber doorway is opened.

The invention further includes a solvent condenser system having a solvent vapor condenser assembly and an atomized vapor condenser assembly that liquifies the vaporized and atomized solvent discharged from the nozzle at substantially the same rate that such vaporized and atomized Freon is created by the nozzle discharge so that the pressure of the air within the cleaning chamber generally stays somewhat below ambient atmosphere pressure.

The atomized solvent condenser assembly of the solvent condenser system performs the bulk of the solvent liquification function, and includes a heat exchanger, a tank shell for enclosing the heat exchanger, and inlet and outlet conduits connected between the tank shell and the chamber interior for defining a circulation path which is deliberately rendered tortuous. A blower is connected to the inlet conduit for circulating all the air within the cleaning chamber through the tank shell once every second. Such a high flow rate causes the droplets of solvent entrained within the chamber air to impinge upon the walls of the tortuous path defined by the tank shell and inlet and outlet conduits during circulation, and collect at the bottom of the tank shell where it is drained back to the solvent sump. The heat exchanger within the tank shell also liquifies most of the solvent vaporized by the solvent nozzle.

The vapor condenser assembly acts as a solvent liquification "plisher" relative the the atomized solvent condenser assembly, and includes includes a heat exchanger, a housing that encloses the heat exchanger, inlet and outlet conduits connected between the housing and the chamber interior for defining a circulation path, and a vacuum pump in communication with the inlet conduit for circulating the air within the cleaning chamber through the heat exchanger. The vapor condenser assembly may also include a throttle valve in the outlet conduit which partially obstructs this conduit so that the vacuum pump creates a negative pressure in the cleaning chamber that draws solvent-laden air out of the chamber and into the heat exchanger which cools this air in order to liquify the solvent. The positive pressure created within the housing by the vacuum pump means is not only used to circulate solvent-free air back into the cleaning chamber, and liquified solvent back into the solvent sump; it also expedites the solvent liquification operation itself. As a further safeguard against the release of volatile solvent into the atmosphere, a film or "curtain" of water may be provided within the housing of the vapor condenser assembly in order to isolate the solvent collected within the housing from the other components of the condenser system. The volume of the housing of the vapor condenser assembly is at least 20 percent and is preferably 50 percent of the volume of the cleaning chamber to provide a hold-up volume that allows the suction pump means to create a significant negative pressure in the cleaning chamber without creating a large positive pressure within the housing. The provision of such a hold-up volume has a further advantageous effect of insuring that the solvent-laden air introduced into the housing from the cleaning chamber will spend a sufficient amount of time within the housing to allow the heat exchanger to thoroughly cool this air and thereby completely remove the vaporized and atomized solvent from the chamber air.

At the door to the cleaning chamber, an air curtain assembly may be provided to establish a secondary method of preventing the escape of any Freon vapor in the event of a malfunction of the solvent condenser system. The air curtain assembly produces a high velocity sheet of air that passes over the door opening area to isolate the chamber atmosphere from the ambient atmosphere. To this end, the air curtain assembly includes a blower and motor and a horizontal exhaust register located above the chamber door.

In the method of the invention, the doorway of the cleaning chamber is opened and the article to be cleaned is to be placed inside on a foraminous floor plate that is disposed above solvent sump. The doorway is then closed, thus sealing the interior of the chamber from the ambient atmosphere. Next, both the vaporized solvent condenser assembly and atomized solvent condenser assembly are actuated in order to draw a negative pressure in the cleaning chamber, as well as to commence circulation of air from the cleaning chamber through the heat exchangers of both assemblies. The article within the cleaning chamber is then cleaned by impinging it with a jet of pressurized solvent from the solvent nozzle.

During the cleaning operation, solvent-laden air is withdrawn from the cleaning chamber and directed into the housing of the solvent vapor condenser assembly. The hold-up volume provided within this housing reduces the flow rate of the solvent laden air to a point where it slowly and intimately flows through the heat exchanger. The relatively high pressure within the housing, in combination with the low temperature generated by the heat exchanger causes vaporized solvent to condense into droplets which collect at the bottom of the housing. At the same time, the circulation of the solvent-laden air from the cleaning chamber through the tortuous path provided by the atomized solvent condenser assembly causes droplets of solvent entrained within the air to impinge against the walls of the tank shell of this assembly, thus causing the solvent to collect at the bottom of the tank. The heat exchanger within the tank shell also liquifies a large portion of the vaporized solvent. The liquid solvent that collects on the bottom of both the housing and the tank shell of the vaporized solvent and atomized solvent condenser is conducted into the solvent collected at the bottom of the sump.

At the termination of the cleaning operation, the solvent nozzle is deacuated, and both the vaporized and atomized solvent condenser assemblies are allowed to run for approximately 10 minutes in order to completely liquify any atomized or vaporized solvent that may be present in the air within the chamber, and as well as to return the solvent to the sump. Finally, both the suction pump and the blower of the vaporized and atomized solvent condenser assemblies are deacuated, and the air curtain assembly actuated, whereupon the door way of the chamber is opened and the clean article removed. In this last step, the curtains of water provided over the volatile cleaning solvent in the sump and in the housing of the solvent vapor condenser assembly prevents the solvent from coming into contact with the ambient atmosphere, while the air curtain generated by the air curtain assembly provides a further safeguard against such contact.

BRIEF DESCRIPTION OF THE SEVERAL FIGURES

FIG. 1 is a schematic diagram of the closed loop cleaning system of the invention.

DETAILED DESCRIPTION OF THE PREFERRED EMBODIMENT

With reference now to FIG. 1, the closed loop solvent cleaning system 1 of the invention generally includes a chamber assembly 3 that may be conveniently supported by a table on coasters (not shown). In the preferred embodiment, the chamber assembly 3 is a rectangular box formed from stainless steel sheet metal which is partitioned into a cleaning chamber 9, a distillation chamber 11, and a solvent reservoir chamber 13. Access to the cleaning chamber 9 is provided by a doorway 16 having a sealing gasket (not shown) along its perimeter for sealing the chamber 9 from the ambient atmosphere when the doorway 16 is closed.

Immediately behind the doorway 16 is an air curtain assembly 17 for producing a high velocity sheet of air behind the doorway 16 that retains any residual Freon fumes in the cleaning chamber 9. To this end, the air curtain assembly includes a high-speed blower mounted within a cylindrical housing having a slot for directing the output of the blower from the top to the bottom edge of the doorway 16. In the preferred embodiment, air curtain assembly may be a 24 inch long, 0.25 horsepower air curtain unit manufactured by Air-Economy located in Flemington, N.J.

One of the sides of the cleaning chamber 9 includes a plexiglass observation window 18. A pair of glove ports **20*a*,20*b* are provided in the stainless steel wall below the window 18 into which a pair of rubber gloves are sealingly mounted. The cleaning chamber 9 forms what is known in the art as a "glove box" wherein a system operator may slide his hands into the gloves mounted in the glove ports 20*a*,20*b* to manipulate the article and observe it through the window 18**.

The top portion of the cleaning chamber 9 includes a pressure meter 21 so that the system operator may monitor the pressure of the air within the chamber 9, as well as an air inlet 22 that includes a valve 23 for equilibrating the pressure within the chamber 9 with atmospheric pressure. An electric light is provided in the ceiling of the cleaning chamber 9 (not shown) for illuminating the article being cleaned. The middle portion of the cleaning chamber 9 contains a solvent nozzle 24 that is connected to a pressurized source of Freon 113 (or some other volatile cleaning solvent), as well as a foraminous floor plate 25 for supporting the tool, garment or other article to be cleaned by the Freon 113 discharged by the nozzle 24. In the preferred embodiment, the nozzle 24 is connected to a source of pressurized cleaning solvent by means of a flexible hose so that it may be easily manipulated within the chamber 9. Additionally, the nozzle 24 has a manually actuated lever for opening and closing the nozzle 24 in much the same way as a hand-operated garden hose nozzle. Immediately beneath the foraminous floor plate 25 is a tapered ledge 26 which not only serves to support the plate 25, but which also advantageously guides liquid solvent down into the solvent sump 28.

The bottom portion of the cleaning chamber 9 includes the solvent sump 28 as is plainly evident in FIG. 1. A sufficient volume of water is provided within the sump 28 to form a 2–3 inch layer 30 or curtain of water over the collected solvent 31. In the preferred embodiment, the water used to form the water layer 30 is demineralized and oxygen-free. The use of such water ensures that no chemical reactions will take place at the interface between the collected solvent 31 and the water layer 30. While a layer of water only a fraction of an inch thick would be generally effective in isolating the collected solvent 31 from the ambient atmosphere, the use of a 2 to 3 inch thick water layer 30 is preferred as such a relatively thick layer will completely envelop the collected solvent 31 at all times even when the chamber assembly 3 is transported or subjected to a mechanical shock which would tend to agitate the collected solvent 31 in the sump 28. A stainless steel screen 32 is provided across the sump 28 just beneath the boundary between the water layer 30 and the collected solvent 31. This stainless steel screen 32 not only prevents relatively large pieces of debris from falling to the bottom of the sump 28 and possibly clogging the drain 37 disposed at the sump bottom; it also helps to dampen the movement of the collected solvent 31 in the event that the chamber assembly 3 is moved or otherwise subjected to mechanical shock. Near the bottom of the sump 28 a waste drain 34 having a drain valve 36 is provided This drain 34 may be used to remove spent solvent from the system 1 when the system operator desires to decommission the system. An outlet conduit 37 is provided on the floor of the sump 28. Outlet conduit 37 conveys used solvent from the sump 28 to the various components of the solvent reclamation system 38 which will be shortly described in detail. Finally, a window 39 preferably formed from plexiglass is provided on one of the sidewalls of the sump 28 so that the system operator may visually monitor both the level of the collected solvent 31, as well as the thickness of the water layer 30.

Turning again to the chamber assembly 3 and a description of the various components of the solvent system 38, the chamber assembly 3 includes an internal wall 40 preferably formed of stainless steel which partitions the cleaning chamber 9 from the distillation chamber 11. The distillation chamber 11 contains an electric heater 42 whose purpose is to boil used cleaning solvent introduced into the chamber 11 incident to a solvent distillation process. Like the solvent sump 28, the distillation chamber 11 includes a waste drain 44 having a drain valve 46 which allows the system operator to remove solvent from the chamber 11 when the system 1 is decommissioned.

The chamber assembly 3 includes another dividing wall 48 which partitions the distillation chamber 11 from the solvent reservoir chamber 13. Unlike the dividing wall 40, wall 48 does not completely isolate the two chambers 11 and 13 which it in part defines. Instead, a gap 50 is provided between the top edge of the dividing wall 48 and the ceiling of the chamber assembly 3 to conduct the gaseous fumes of solvent generated when the electric heater 42 brings used solvent to a boil within the distillation chamber 11. These gaseous fumes condense within the solvent reservoir chamber 13, thus creating a reservoir of clean solvent which is ultimately recycled back through the solvent nozzle 24 for reuse. The top of the solvent reservoir chamber 13 includes a fill port 52 where cleaning solvent may be introduced incident to start-up, while the bottom of the chamber 13 includes a drain conduit 54 that is connected to the previously mentioned outlet conduit 37 by way of a valve 56. Under normal operating conditions, valve 56 is closed.

Outlet conduit 37 is connected to the inlet of a solvent pump 58. The purpose of the solvent pump 58 is to recirculate the used solvent collected in the sump 28 back to a high pressure solvent pump 72 for ultimate reuse. Pump 58 is preferably a model 2P125 self priming inpeller-type pump manufactured by the Dayton Electric Manufacturing Company located in Chicago, Ill. The outlet of the pump 58 is in turn connected to an outlet conduit 60 that includes two, serially-connected cartridge-type filters 62 and 64. Filter 62 is capable of filtering out all particles in the collected solvent 31 having a width of 5 microns or greater, while filter 64 is capable of filtering out all such particles having a width of 1 micron or greater. The 1 micron filter 64 is located downstream of the 5 micron filter 62 so that the two filters 62 and 64 may become saturated with particulate debris at approximately the same rate. A pressure gauge 66 is included in the conduit 60 between the outlet of the solvent pump 58 and the inlet of the filter 62 so that the back pressure (and hence the extent of particle saturation) of the filters 62 and 64 may be monitored by the system operator.

A three-way valve 68 is provided in the conduit 60 downstream of the 1 micron filter 64. This three-way valve 68 includes an outlet connected to a conduit 70 that leads to the distillation chamber 11, as well as an outlet that is connected to a conduit 71 that leads to the inlet of the high pressure solvent pump 72. Under normal operating conditions, the three-way valve 68 will conduct all of the solvent it receives from the conduit 37 through the pump conduit 71. A recirculation conduit 76 is connected to the conduit 71 upstream of the inlet to the high pressure solvent pump 72. The other end of this recirculation conduit 76 is connected to the top of the solvent reservoir tank 13 by way of a valve 78. Under normal operating conditions, valve 78 is closed.

The outlet of the high pressure solvent pump 72 is connected to the solvent nozzle 24 disposed within the cleaning chamber 9 by way of an outlet conduit 80 that has a shutoff valve 81, as well as a pressure meter 82 for monitoring the pressure of the solvent flowing out of the outlet of the pump 72. The high pressure solvent pump 72 preferably has the ability to pressurize the cleaning solvent that it receives in its inlet anywhere between 0 and 2,000 psig. In the preferred embodiment, high pressure solvent pump 72 is a model 530 CAT pump manufactured by CAT located in Minneapolis, Minn. This pump is driven by a three phase, 7 and ½ horse power motor which may be a model no. M37107 electric motor manufactured by Baldor Electric Company located in Fort Smith, Ark.

Turning now to the solvent condenser system 83, this system generally comprises an atomized solvent condenser assembly 84, and a solvent vapor condenser assembly 86. Both of these condenser assemblies 84 and 86 include heat exchangers which are powered by a main refrigeration unit 88. Specifically, the heat exchanger contained within the atomized solvent condenser 84 is connected to the refrigeration unit 88 by way of refrigeration conduits **89*a* and 89*b* having valves 90*a*90*b*, while the heat exchanger contained within the solvent vapor condenser 86 is connected to the unit 88 by way of refrigeration conduits 91*a* and 91*b* having valves 92*a* and 92*b*. In the preferred embodiment, the refrigeration unit 88 has a one and one-half ton capacity. An example of a commercially available refrigeration mechanism which may be used as the unit 88 is the model 99.500 refrigerator manufactured by Tecumseh, Incorporated located in Tecumseh, Mich. The applicants have verified by experimentation that a refrigeration unit 88 having a one and one-half ton capacity is sufficient when used in combination with the high-efficiency heat exchanger designs incorporated within the condenser assemblies 84 and 86 to liquify cleaning solvent just as fast the high pressure pump 72 is capable of vaporizing and atomizing such solvent through the nozzle 24. Such a capability is, of course, an important factor which contributes to the system's ability to use volatile cleaning solvents in a completely closed-loop, atmosphere-insulating fashion as it prevents any particular portion of the system 1** from being exposed to an over pressure condition.

The atomized solvent condenser assembly 84 performs the bulk of the solvent condensation function 1 and is formed from a first air recirculation outlet 94 disposed in a side wall of the cleaning chamber 9 above the solvent sump 28. This outlet 94 is connected to a high speed blower 95 by way of an outlet conduit 96. The outlet of the blower 95 is connected to a condenser tank shell 98 by way of an outlet conduit 100. A heat exchanger coil 101 is concentrically disposed within the cylindrically shaped tank shell 98. As has been previously indicated, the inlet and outlet of this coil 101 is in turn connected to the inlet and outlet conduits **89*a*, 89*b* of the refrigeration unit 88. The blower outlet conduit 100 is deliberately connected at the top end of the cylindrically shaped condenser tank shell 98 so that it blows a stream of air along the longitudinal axis of the condenser coil 101. An air outlet conduit 102 is connected at a bottom portion of the condenser tank shell 98 and loops over the top of the shell and back into communication with the cleaning chamber 9. As is evident from FIG. 1, the vertically oriented condenser tank shell 98 and the air outlet conduit 102 form a tortuous path which causes atomized droplets of cleaning solvent entrained within the stream of air blown out of the blower outlet to impinge on the inner walls of the tank shell 98. These droplets, of course, ultimately drain down the internal walls of the tank shell 98 and collect at the bottom of this shell. The resulting collected solvent is recirculated back to the cleaning chamber 9 by way of a solvent recirculation conduit 103 which terminates in an inlet port 104. Conduit 103 includes a pair of flow valves 105*a* and 105*b* for isolating the condenser tank shell 98 from the interior of the cleaning chamber 9 when the system 1 is shut off. In the preferred embodiment, blower 95 is a model no. AF-8 fan manufactured by the American Fan Company located in Cincinnati, Ohio. This fan has a 600 c.f.m. flow capacity and is powered by a three-quarter horse power, 220 volt catalog no. 1453MV motor manufactured the Balder Electric Company located in Fort Smith, Ark. Additionally, the coil 101 which forms the heat exchanger of the atomized solvent condenser assembly 84 is preferably formed from three separate coils of one-half inch copper tubing that are approximately 30 inches long apiece. Each of these coils has approximately 30 windings. The use of such long, multi-winding coils ensures intimate contact between these coils and the air blown through the tank shell 98, and also provides a large number of irregular flow paths through the tank shell 98 which compliments the configuration of the tank shell 98 and the conduit 102 in providing a tortuous path for the air blown through the atomized solvent condenser assembly 84. A pressure meter 110 is connected to a sidewall of the tank shell 98 so that the system operator may monitor the pressure within the shell 98**.

The solvent vapor condenser assembly 86 begins with a second air recirculation outlet 114 disposed on the side of the cleaning chamber 9 as shown. This recirculation outlet 114 is connected to the inlet of a vacuum pump 116 by way, of outlet conduit 118. In the preferred embodiment, vacuum pump 116 is a model no. 1065V3B vacuum pump manufactured by GAST in Benton Harbor, Mich. The outlet of the vacuum pump 116 is connected to the inlet of a condenser housing 120 by way of a valve 122 as shown. Pressure gauges 124 and 126 flank the inlet and outlet ends of the vacuum pump 116 so that the pressure differential generated thereby may be readily monitored by the system operator. A condenser unit 128 is disposed within the interior of the housing 120. As has been indicated earlier, this condenser unit 128 is connected to the refrigeration unit 88 by way of inlet and outlet conduits **91*a* and 91*b*. In the preferred embodiment. condenser unit is formed from 27 feet of quarter-inch copper tubing having one inch fins spaced one inch apart. The tubing is preferably wound in serpentine fashion. At its bottom portion, the condenser housing 120 includes a liquid solvent outlet conduit that is connected to an outlet 131 located in the side of the cleaning chamber 9 just above the sump 28. From time to time, liquid solvent 133 condensed by the condenser unit 128 is discharged to the sump 28 through outlet 131 by way of valve 132. To isolate the solvent 133 collected within the housing 120 from the ambient atmosphere when doorway 16 is opened, a layer 136 of water may be provided within the housing 120 as shown. At the top of the condenser housing 120, an air recirculation outlet conduit 134 is provided for recirculating solvent-free air back into the cleaning chamber 9. A throttle valve 135 is provided in conduit 134 for both creating a back pressure in the flow of air back to the chamber 9, and for isolating the chamber 9 from the housing 120 when the doorway 16** is opened.

Like the cleaning chamber 9, the condenser housing 120 is preferably formed from stainless steel sheet material. Moreover, the internal volume of the condenser housing 120 is at least about 20 percent and preferably about 50 percent of the volume of the cleaning chamber 9 for two reasons. First, such proportioning provides a hold-up volume within the housing 120 sufficiently large to significantly slow the solvent-laden air entering the housing by way of conduit 118 to give this air sufficient time to come into intimate contact with the condenser unit 128. Secondly, the hold-up volume provided within the housing 120 allows the vacuum pump 116 to draw a significant subatmospheric pressure within the cleaning chamber 9 while inducing only a moderate positive pressure within the housing 120. If the housing 120 were only a tiny fraction of the volume of the cleaning chamber 9, the vacuum pump 116 would have to produce a considerable pressure within it in order to draw any significant negative pressure within the cleaning chamber 9 if the system is to remain closed-loop. In operation, the pressure differential generated by vacuum pump 116 is controlled in large measure by throttle valve 135. The more throttle valve 135 is closed, the greater the pressure differential between the negative pressure generated within the cleaning chamber 9 and the positive pressure generated within the condenser housing 120.

Where the cleaning chamber 9 has a large capacity, a receiver tank 137 may be provided in order to increase the hold-up volume of the solvent vapor condenser assembly 86. Such a receiver tank 137 may be connected to a sidewall of the condenser housing 120 by way of a conduit 139 (indicated in phantom). A check valve 141 included within the conduit 139 prevents any back-flow of air from the tank 137 into the housing 120. An outlet conduit 143 (also shown in phantom) is used to recirculate air and liquid solvent that has been forced into the tank 137 by the action of the vacuum pump 116 back into the cleaning chamber 9. Such a recirculation of air and liquid solvent is controlled by manipulation of the valve 145 which is provided in the conduit 143.

In the method of the invention, the article to be cleaned is placed on top of the foraminous screen 25 within the cleaning chamber 9 through the doorway 16, whereupon the doorway 16 is closed, thereby creating an air tight seal between the interior of the cleaning chamber 9 and the ambient atmosphere. Next, the solvent condenser system 83 is actuated by starting up the refrigeration unit 88, and by actuating the blower 95 of the atomized solvent condenser assembly 84 and the vacuum pump 116 of the vaporized solvent condenser assembly 86. After the vacuum pump 116 has had an opportunity to produce a soft subatmospheric pressure within the cleaning chamber 9, the system operator places his hands within the gloves mounted in the glove ports **20*a* and 20*b* in the side of the cleaning chamber 9, and commences to clean the article by squeezing the actuation lever on the solvent nozzle 24**.

As soon as the system operator squeezes the lever on the solvent nozzle 24, the high pressure solvent pump 72 of the solvent reclamation system is actuated to generate a jet of cleaning solvent out of the solvent nozzle 24 which may be pressurized anywhere between 0 to 2,000 psi. As soon as this jet is created, the air within the chamber 9 becomes laden with both atomized and vaporized cleaning solvent. While some of the solvent stays in liquid form and runs down through the tapered ledges 16 of the chamber 9 and through the water layer 30 and into the pool of collected solvent 31 at the bottom of the sump 28, the solvent that is entrained in the air within the chamber 9 is very rapidly separated from this air by the combined action of the atomized solvent and vaporized solvent condenser assemblies 84 and 86. As has been previously indicated, the air circulated through the tank shell 98 of the atomized vapor condenser assembly 84 and back up through the conduit 102 is flung out against the walls of the tank shell 98 and conduit 102 and is collected at the bottom of the shell 98 and recirculated back to the solvent sump by way of conduit 103. The flow rate of the blower 95 is selected such that the volume of the air within the cleaning chamber 9 is circulated completely through the atomized vapor condenser assembly 84 once every second. Additionally, the heat extracted from the air circulated by the blower 95 by the coil 101 within the tank shell 98 liquifies most of the vaporized cleaning solvent contained within this air. The operation of the vaporized solvent condenser assembly 86 compliments the function of the atomized solvent condenser assembly 84 and removes substantially all of the remaining vaporized solvent from the air circulated therethrough by the vacuum pump 116. The relatively large hold-up volume of the housing 120 of this assembly 86 causes the air introduced into the housing 120 to slowly and intimately contact the fins of the heat exchanger 128. Additionally, the positive pressure generated within the housing 120 encourages vaporized solvent to liquify. During the actual cleaning operation, the throttle valve 135 is adjusted so as to create a pressure differential of 5 and 18 psi between the cleaning chamber 9 and the condenser housing 120, depending upon ambient temperature. A setting within this range allows the solvent condenser system 83 to liquify the solvent contained in the relatively large volume of solvent-laden air produced within the cleaning chamber 9 when the solvent nozzle 24 is either continuously or intermittently actuated. At this time, it should be noted that most of the pressure differential between the chamber 9 and the housing 120 is the result of the fact that the pressure in the housing 120 is positive; the pressure in the chamber 9 is adjusted to near ambient by an initial introduction of air from the atmosphere through air inlet conduit 22 at start-up. During operation, the pressure in the chamber 9 is maintained at near ambient by a steady state recirculation of air from the housing 120 to the chamber 9.

After the article within the cleaning chamber 9 has been cleaned, the throttle valve 135 is tightened to the extent necessary to create a pressure of approximately 20 psi in the housing 120. While the tightening of the valve 135 reduces the rate that vacuum pump 116 circulates the air through the cleaning chamber 9, it also increases the contact time between solvent-laden air arriving from the cleaning chamber 9 and the condenser unit 128 disposed from within the housing 120. The increase in contact time condenses substantially all of the cleaning solvent in the air within the cleaning chamber 9. This "ringing out" step lasts approximately ten minutes.

After the solvent condenser system 83 has been given an opportunity to remove substantially of the solvent within the cleaning chamber 9, blower 95 and vacuum pump 116 are deactuated, and isolation valves **105*b* and 132 are closed, as is throttle valve 135. Air curtain assembly 17 is actuated. Doorway 16 is then opened to remove the cleaned article from the chamber 9. While liquid solvent is present within the solvent sump 28, the layer of water 30** effectively isolates this solvent from the ambient atmosphere.

Of course, the pressurized air within the housing 120 will ultimately have to be released at some time. However, such a release need not occur until after a large number of cleaning cycles. To prevent the escape of any solvent during such release, the condenser unit 128 is run for 10 minutes or more to remove essentially all vaporized solvent from this air. This air is then transferred via conduit 134 to the cleaning chamber 9 and then released out of doorway 16. During such release, the layer of water 136 in the housing 120 effectively isolates the solvent collected from this air from the ambient atmosphere, as does the air curtain produced by the air curtain assembly 17.

We claim:

1. A closed system for cleaning articles by means of a volatile cleaning solvent, comprising:

a cleaning chamber having a doorway means for allowing access to the interior of the chamber and for sealing the chamber interior from the ambient atmosphere;

a nozzle means disposed within said chamber for selectively discharging vaporized and atomized volatile cleaning solvent on an article within said chamber incident to a cleaning operation, and a solvent sump for collecting liquid solvent from said chamber, wherein said sump includes a quantity of isolating fluid for forming a film over the top surface of the collected solvent that isolates the collected solvent from the ambient atmosphere when said chamber doorway means is opened.

2. A closed system for cleaning articles as defined in claim 1, wherein the isolating fluid is a liquid having a density that is less than the density of the cleaning solvent.

3. A closed system for cleaning articles as defined in claim 2, wherein the isolating liquid is water, and the cleaning solvent is a liquid fluorocarbon.

4. A closed system for cleaning articles as defined in claim 1, further comprising a solvent condenser system in thermal communication with the interior of said cleaning chamber for condensing vaporized and atomized cleaning solvent into liquid cleaning solvent.

5. A closed system for cleaning articles as defined in claim 4, wherein said condenser system liquifies vaporized and atomized cleaning solvent at substantially the same rate as vaporized and atomized solvent is discharged from said nozzle means to maintain a pressure within said cleaning chamber that does not rise above ambient atmospheric pressure.

6. A closed system for cleaning articles as defined in claim 4, wherein said condenser system includes an atomized solvent condenser assembly having a heat exchanger, a tank shell for enclosing the heat exchanger, and inlet and outlet conduits connected between the tank shell and the chamber interior for defining a circulation path through said heat exchanger, wherein said tank shell and said conduits define a tortuous path.

7. A closed system for cleaning articles as defined in claim 6, wherein said atomized solvent condenser system further includes a blower means for circulating the air within said cleaning chamber through said tortuous path and said heat exchanger such that droplets of cleaning solvent entrained in said air impinge against the heat exchanger and tank shell and collect at the bottom of the tank shell.

8. A closed system for cleaning articles as defined in claim 4, wherein said condenser system includes a vapor condenser assembly having a heat exchanger, a housing that encloses the heat exchanger and serves as an air reservoir, inlet and outlet conduits connected between said housing and said chamber interior for defining a circulation path, and a vacuum pump means in communication with one of said conduits for circulating the air within said cleaning chamber through said heat exchanger and for creating a pressure differential between said cleaning chamber and said housing.

9. A closed system for cleaning articles as defined in claim 8, wherein vaporized solvent condensed by said heat exchanger collects at the bottom of said housing, and said housing includes a quantity of isolating fluid for forming a film over the collected solvent that isolates said solvent from the outlet conduit that communicates with the interior of the cleaning chamber.

10. A closed system for cleaning articles as defined in claim 8, wherein said vapor condenser assembly further includes a throttle valve located in said outlet conduit for obstructing the flow of the chamber atmosphere through said vacuum pump means induces a negative pressure in said cleaning chamber and a positive pressure in said housing.

11. A closed system for cleaning articles by means of a volatile cleaning solvent, comprising:

a cleaning chamber having a doorway means for allowing access to the interior of the chamber and for sealing the chamber interior from the ambient atmosphere;

a nozzle means disposed within said chamber for selectively discharging vaporized and atomized volatile cleaning solvent on an article within said chamber incident to a cleaning operation;

a closed loop solvent condenser system for liquefying vaporized and atomized cleaning solvent at the same rate that said nozzle means discharges said vaporized and atomized solvent including a vaporized solvent condenser assembly having a heat exchanger, a housing that encloses the heat exchanger and serves as an air reservoir, inlet and outlet conduits connected between said housing and said chamber, and a vacuum pump means for circulating the air within said cleaning chamber through said heat exchanger in order to remove vaporized solvent therefrom and for creating a negative pressure in said chamber and a positive pressure in said housing when said nozzle means discharges solvent, and a solvent sump for collecting liquid solvent from said cleaning chamber, wherein said sump includes a quantity of isolating fluid for forming a film over the top surface of the collected solvent that isolates the collected solvent from the ambient atmosphere when said chamber doorway means is opened.

12. A closed system for cleaning articles as defined in claim 11, wherein said solvent condenser system further includes an atomized solvent condenser assembly having a heat exchanger, a tank shell for enclosing the heat exchanger, and inlet and outlet conduits connected between the tank shell and the chamber interior for defining a circulation path through said heat exchanger, wherein said tank shell and said conduits define a tortuous path.

13. A closed system for cleaning articles as defined in claim 12, wherein said atomized solvent condenser assembly further includes a blower means for circulating the air within said cleaning chamber through said tortuous path and said heat exchanger such that droplets of cleaning solvent entrained in said air impinge against the heat exchanger and tank shell and collect at the bottom of the tank shell.

14. A closed system for cleaning articles as defined in claim 11, wherein vaporized solvent condensed by said heat exchanger collects at the bottom of said housing, and said housing includes a quantity of isolating fluid for forming a film over the collected solvent that isolates said solvent from the outlet conduit that communicates with the interior of the cleaning chamber.

15. A closed system for cleaning articles as defined in claim 11, wherein the volume of said housing is at least 10 percent of the volume of the cleaning chamber.

16. A closed system for cleaning articles as defined in claim 11, wherein the volume of said housing is at least 20 percent of the volume of the cleaning chamber.

17. A closed system for cleaning articles as defined in claim 11, wherein said cleaning chamber includes an air inlet for equalizing the air pressure within the chamber with the pressure of the ambient atmosphere.

18. A closed system for cleaning articles as defined in claim 11, wherein said housing includes a third conduit connected to the sump at a point beneath said isolating film for combining the solvent condensed by the heat exchanger with the solvent present in said sump.

19. A closed system for cleaning articles as defined in claim 11, wherein said cleaning chamber includes a tapered ledge for funneling liquid solvent into said sump.

20. A closed system for cleaning articles by means of a volatile cleaning solvent, comprising:

a cleaning chamber having a doorway means for allowing access to the interior of the chamber and for sealing the chamber interior from the ambient atmosphere;

a nozzle means disposed within said chamber for selectively discharging vaporized and atomized volatile cleaning solvent on an article within said chamber incident to a cleaning operation;

a solvent sump for collecting liquid solvent from said chamber including a quantity of isolating fluid having a density less than the density of the cleaning solvent for forming a film over the top surface of collected solvent in order to isolate the collected solvent from the ambient atmosphere, and a closed loop solvent condenser system for liquifying vaporized and atomized solvent within the cleaning chamber at substantially the same rate that said nozzle means discharges said solvent, including a vaporized solvent condenser assembly having a heat exchanger, a housing surrounding said heat exchanger, inlet and outlet conduits connected between said housing and said chamber for defining a circulation path for air within said chamber, a vacuum pump means in communication with said inlet conduit for creating a negative pressure in said chamber and a positive pressure in said housing, and a valve means in said outlet conduit for creating a pressure differential between said chamber and said housing, wherein the internal volume of the housing is at least 20 percent of the internal volume of the cleaning chamber.

21. A closed system for cleaning articles as defined in claim 20, wherein said condenser assembly includes an atomized solvent condenser assembly having a heat exchanger, a tank shell for enclosing the heat exchanger, and inlet and outlet conduits connected between the tank shell and the chamber interior for defining a circulation path through said heat exchanger, wherein said tank shell and said conduits define a tortuous path.

22. A closed system for cleaning articles as defined in claim 21, wherein said atomized solvent condenser assembly further includes a blower means for circulating the air within said cleaning chamber through said tortuous path and said heat exchanger such that droplets of cleaning solvent entrained in said air impinge against the heat exchanger and tank shell and collect at the bottom of the tank shell.

23. A closed system for cleaning articles as defined in claim 20, wherein said housing of said vaporized solvent condenser assembly includes a quantity of liquid for forming a film over the solvent collected within the housing to isolate said collected solvent from the ambient atmosphere.

24. A closed system for cleaning articles as defined in claim 11, further comprising an air curtain means mounted within said cleaning chamber for preventing air within said chamber from escaping into the ambient atmosphere when said chamber doorway means is opened.

* * * * *